US006911778B1

(12) United States Patent
Kroone

(10) Patent No.: US 6,911,778 B1
(45) Date of Patent: Jun. 28, 2005

(54) IGNITION CONTROL CIRCUIT FOR GAS DISCHARGE LAMPS

(75) Inventor: Gerhard Laurens Kroone, Schagen (NL)

(73) Assignee: Dutch Electro B.V., Nuth (NL)

( * ) Notice: Subject to any disclaimer, the term of this patent is extended or adjusted under 35 U.S.C. 154(b) by 111 days.

(21) Appl. No.: 10/369,328

(22) Filed: Feb. 18, 2003

(51) Int. Cl.[7] ..... H05B 37/00
(52) U.S. Cl. ..... 315/105; 305/107; 305/DIG. 7
(58) Field of Search ..... 315/106, 107, 315/105, DIG. 7

(56) References Cited

U.S. PATENT DOCUMENTS 3,710,065 A * 1/1973 Crapuchettes ..... 219/715
5,030,887 A * 7/1991 Guisinger ..... 315/158

* cited by examiner

*Primary Examiner*—David Vu
(74) *Attorney, Agent, or Firm*—Kirkpatrick & Lockhart Nicholson Graham LLP; Anthony H. Handal

(57) ABSTRACT

The disclosure includes an ignition control circuit comprising a transformer having at its secondary side an operating winding, and at least one filament winding. In a pre-heating phase, only the filament winding, which is normally connected to the filaments of a lamp, is active. In this way, the filaments of the lamp are heated first. After a predetermined time, the secondary operating winding is switched on, by a triac. This triac is a compact component producing no or little heat. The invention provides a simple and economic ignition circuit for gas discharge lamps.

22 Claims, 2 Drawing Sheets

IGNITION CONTROL CIRCUIT FOR GAS DISCHARGE LAMPS

FIELD OF THE INVENTION

The present invention relates to an electronic circuit for controlling the ignition of a gas discharge lamp.

PRIOR ART

In such circuits before ignition of the lamp, filaments of the lamp are heated by a low voltage AC current. Then, after a delay, a high voltage AC operating current is applied across opposite filaments or electrodes of the lamp. By pre-heating the filaments the lifetime of fluorescent lamps is prolonged. The duration of the delay times between the pre-heating of the filaments and the ignition of the lamp is crucial. Known circuits consist of an oscillator and a transformer including an operating winding and a filament heating winding. Initially, current through the operating winding is switched off by way of a serial switch. Known circuits for example use a relay as the switching device. These relays take up a considerable amount of space and are not very reliable. As an alternative, circuits are designed using non-moving elements. One example is described in U.S. Pat. No. 4,214,186. There, a rectifier is provided having AC input terminals, one connected to an end of an operating winding and the other connected to an end of an auxiliary ignition winding by a resistor. A resistive ballast is connected across a pair of DC output terminals of the rectifier. This resistive ballast comprises an NTC. The normally high resistance of the NTC decreases after heating. This results in a current through the ignition winding, which results in a delayed ignition of a lamp.

Once the lamp is burning, a DC current is sill flowing through the NTC. This results in a continuous heating of the NTC component, which leads to energy loss and unwanted heating of the total circuit.

It is an object of the present invention to provide an ignition control circuit for the ignition of gas discharge lamps, which is compact and wherein heat production in the circuit is minimised.

SUMMARY OF THE INVENTION

The object of the present invention is achieved by an electronic circuit for controlling the ignition of a pre-heat type gas discharge lamp comprising:

- an operating winding for supplying a high voltage AC to opposite electrodes of the gas discharge lamp;
- filament power supply means for heating filaments of the gas discharge lamp;
- a delay switch for switching on of the operating winding only after a predetermined delay time after a switching on of the filament power supply means, wherein said delay switch comprises a solid-state switch. By using a single solid state switch, a switching circuit is provided with very few components, and with no or little heat dissipation.

In one embodiment the electronic circuit comprises;

- a transformer comprising primary windings and secondary windings, arranged to transform a low voltage AC current in a primary part of the circuit into a high voltage AC current in a secondary part of the circuit;
- an oscillator connected to the primary windings of the transformer, and wherein the secondary windings comprise the operating winding.

Advantageously, a simple circuit is realized.

Moreover, in a further embodiment the present invention relates to a circuit as described above, wherein the filament power supply means comprise filament heating windings which are being part of the secondary windings.

By using filament heating windings as filament power supply means and by using only one transformer in which the secondary windings comprise both the operating winding and the filament windings, an even simpler circuit is realized.

In a preferred embodiment the solid-state switch comprises a triac. The triac is very suitable for switching an AC current. The triac is a solid state switch which produces very little heat. This saves energy which may be very important in application wherein a lamp is powered by a low power a battery.

Preferably a capacitor is arranged in the secondary part of the circuit which contains the operating winding and the triac, wherein the capacitor and the operating winding have been dimensioned in such a way that the overall frequency of the circuit decreases as soon as the triac is switched on and the discharge process in the fluorescent lamp has started.

The present invention also relates to a lighting fixture comprising an electronic circuit as described above.

BRIEF DESCRIPTION OF THE DRAWINGS

Below, the invention will be explained with reference to some drawings, which are intended for illustration purposes only and not to limit the scope of protection as defined in the accompanying claims.

DESCRIPTION OF PREFERRED EMBODIMENTS

Figure 1:
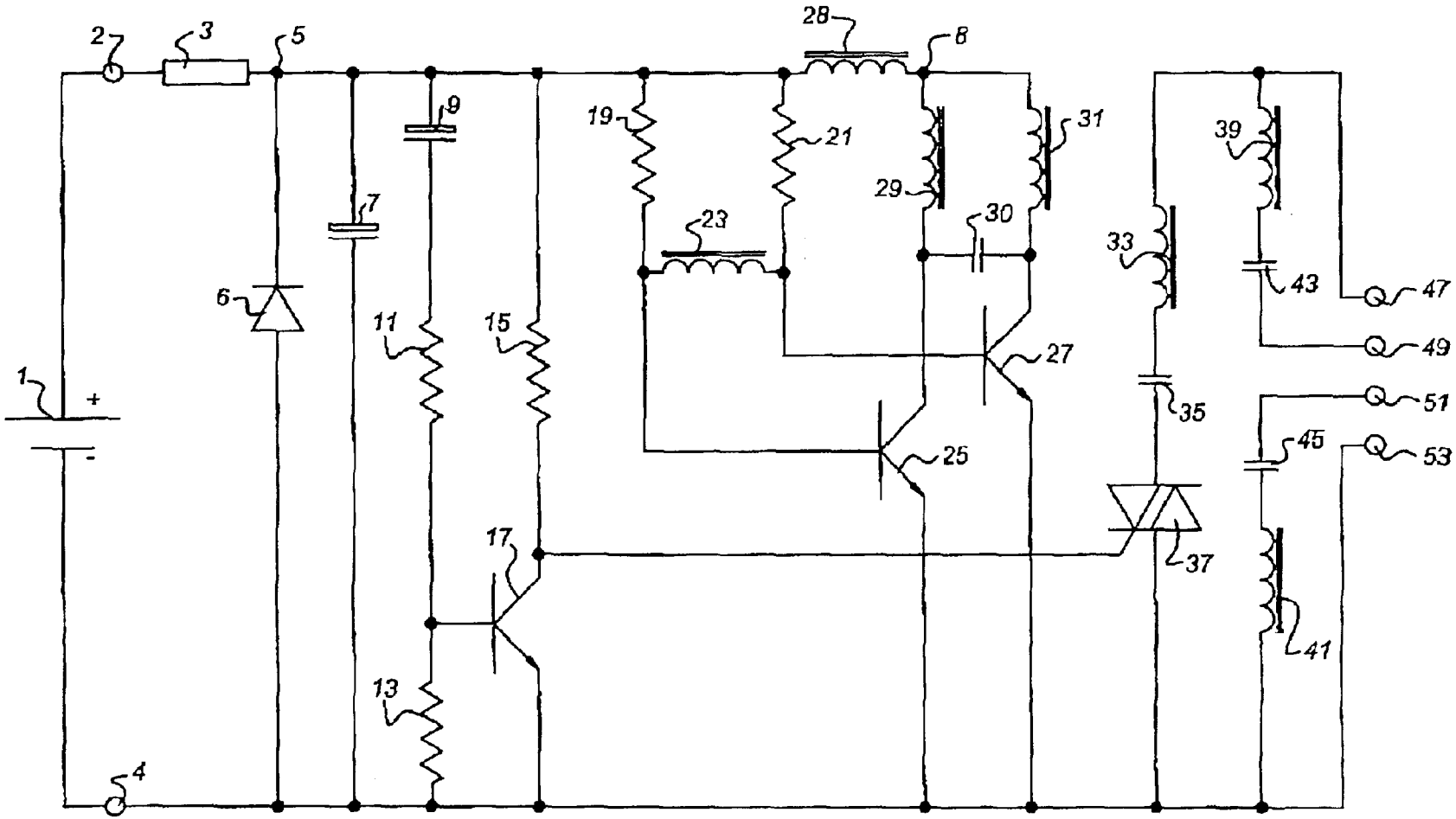
FIG. 1 shows an ignition control circuit according to the invention.

FIG. 1 shows an ignition control circuit according to the invention, connected to a low voltage DC voltage source 1 via a positive 2 and a negative 4 terminal. The voltage source 1 may for example be a 12 or 24 DC voltage source. At the positive terminal 2 a first side of a fuse 3 is connected, the other side of which is connected to a junction point 5. To the junction point 5, a diode 6 and a capacitor 7 are connected at their first side, both of which are at their other side, connected to the negative terminal 4. In addition, the junction point 5 is connected to a capacitor 9, which is serially connected with a resistor 11 and another resistor 13. The junction point 5 is also connected to a resistor 15, which is serially connected to the collector of a transistor 17. The base of transistor 17 is connected to a junction point between resistor 11 and resistor 13. The emitter of transistor 17 is connected to the negative terminal 4. The junction point 5 is also connected to a first side of two resistors 19, 21, which are connected with each other at their second side via a primary winding 23 of a transformer. The second side of the resistor 19 is also connected to the base of a transistor 25. The second side of the resistor 21 is connected to the base of another transistor 27. Another primary winding 28 of the transformer is connected with one side to junction point 5 and with another side to a junction point 8. The collector of the transistor 25 is connected to one side of yet another primary winding 29, the other side of which is connected to the junction point 8. The collector of the transistor 27 is connected to one side of another primary winding 31, the other side of which is connected to the junction point 8. The emitters of both transistors 25 and 27 are connected to negative terminal 4. Between the collectors of the transistors 25 and 27, a capacitor 30 is situated A second part of the ignition circuit comprises three secondary windings of the transformer mentioned above, i.e. an operating winding 33 and two filament windings 39, 41. The operating winding 33 connects an output terminal 47 with an output terminal 53 via a series connection of a capacitor 35 and a triac 37. The filament winding 39 connects output terminal 47 to an output terminal 49 via a capacitor 43, and the filament winding 41 connects output terminal 53 to an output terminal 51 via a capacitor 45. Triac 37 has a control gate that is controlled by a low voltage junction in the primary part of the circuit. In the embodiment shown, this low voltage junction is the collector of transistor 17.

In this circuit the part comprising the primary windings 23, 29, 31 can be regarded as a primary part of the circuit, the part of the circuit comprising the secondary windings 33, 39, 41 is the secondary part of the circuit.

When the voltage source 1 is switched on, the primary part of the circuit, i.e. the resistors 19 and 21, the primary windings 23, 29 and 31 and the transistors 25 and 27 will behave as an oscillator. The oscillator will have a startup-resonance frequency in accordance with the impedance of the circuit as determined while the triac still in its off-state. This oscillator contains the primary windings 23, 29, 31 of the transformer. Via a magnetic core of the transformer, a magnetic field produced by the oscillating primary windings 23, 29, 31 may produce an oscillating current in all the secondary windings 33, 39, 41.

As will be obvious to the skilled person, other embodiments are possible. In stead of using only one transformer, two or more transformers can be used. For example, the operating winding may be part of one transformer, while the filaments maybe part of another transformer. Further, it is noted that alternatively the filaments may be heated by a different type of power supply such as a DC source, in stead of filament heating windings.

Figure 2:
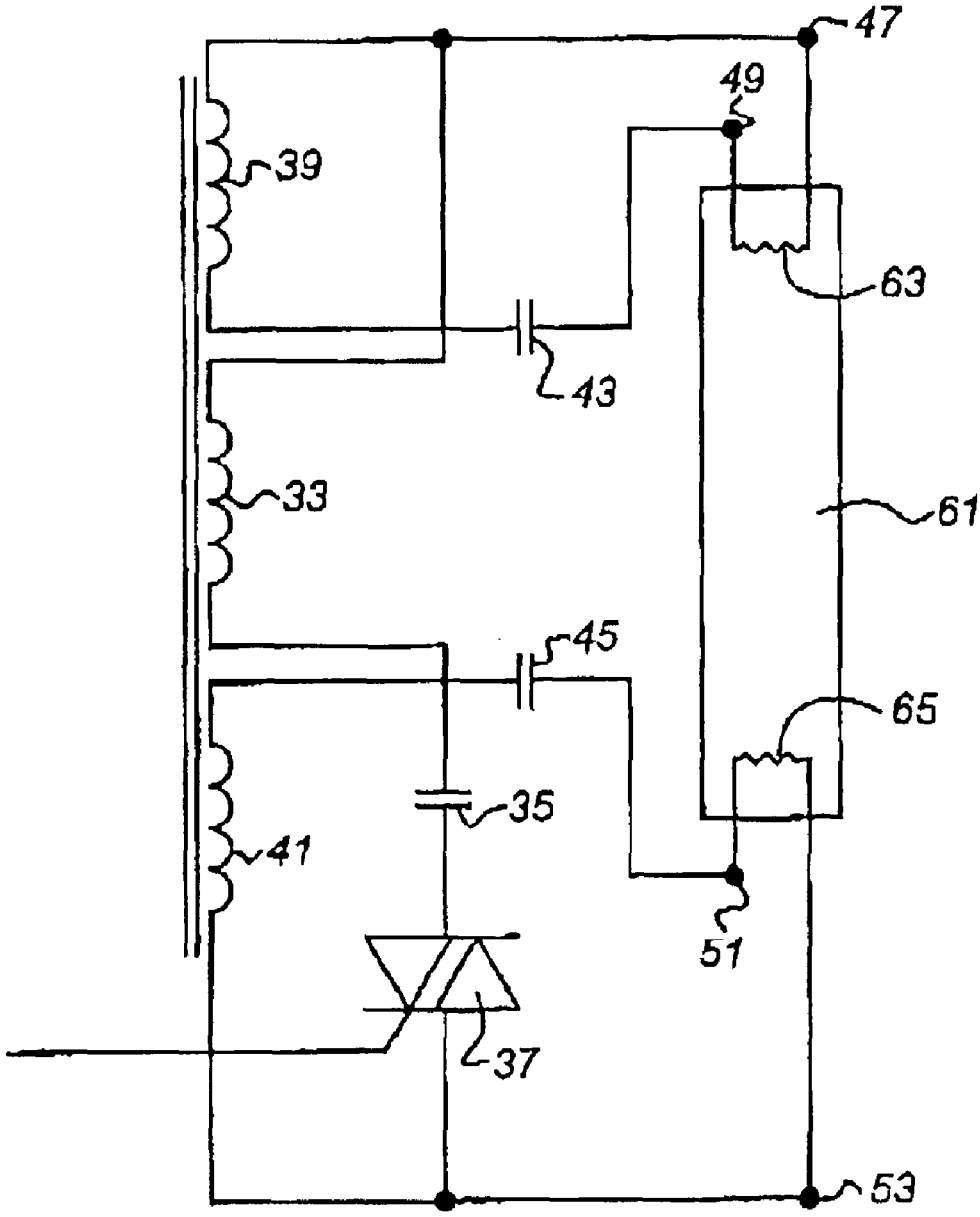
FIG. 2 is a schematic diagram of a secondary pan of the circuit according to an embodiment of the invention, connected to a gas discharge lamp.

FIG. 2 is a schematic diagram of the secondary part of the ignition circuit according to an embodiment of the invention. In FIG. 2, the circuit is connected to a gas discharge lamp 61. The gas discharge lamp 61 comprises two filaments 63, 65. In the gas discharge lamp 61 a gas is present which will get discharged if a sufficient voltage is applied between the filaments 63, 65. FIG. 2 shows the four circuit output terminals 47, 49, 51, 53 as already described in FIG. 1. If the circuit is connected to the gas discharge lamp 61, the terminals 47 and 49 are connected to filament 63, and the terminals 51 and 53 are connected to filament 65. When a magnetic field is present in the transformer, an AC current will flow through the filament windings 39, 41. This results in heating of the filaments 63, 65 of the lamp 61.

The operating winding 33 is arranged to produce a high voltage. This voltage will ignite gas present in the gas discharge lamp 61, as soon as the triac 37 switches to the on state. The switching of the triac 37 is controlled by a voltage divider formed by resistor 15 and transistor 17. This transistor 17 is controlled by another voltage divider formed by capacitor 9, resistor 11 and resistor 13. If the voltage source 1, connected between terminals 2 and 4, is switched on, the capacitor 9 first functions as a 'short circuit' and the base of transistor 17 receives a voltage to open transistor 17, i.e. to bring the collector of transistor 17 to a voltage close to the emitter voltage.

Consequently, triac 37 is closed. However, capacitor 9 will gradually be charged, resulting in a decreasing potential at the base of the transistor 17. The transistor 17 functions as a switch to control the gate of the triac 37. Once the transistor 17 closes, the potential at the gate of triac 37 is triggered. This will result in a conducting triac 37, which in turn facilitates an operating AC current through the operating winding 33. Because the capacitor 7 needs some time to be charged, the triac 37 will only be switched on after a predefined delay period which is defined by the value of the capacitor 9, the resistor 11 and the resistor 13.

In the secondary part of the circuit, the operating winding 33 and the capacitor 35 form a resonator, which has a resonance frequency determined by the capacitance and inductance of the elements 33 and 35, respectively. Preferably, the operating winding 33 and the capacitor 35 are dimensioned in such a way that the resonance frequency of the resonator is lower than the startup-resonance frequency of the oscillator in the primary part of the circuit. Thus, since the overall impedance of the circuit changes when the triac enters its on-state (to switch on the operating winding 33) and a discharge in the gas discharge lamp 61 is started, the frequency of the oscillator in the primary circuit during the pre-heat period, at startup resonance frequency $F_{fil}$, will drop considerably at that moment, resulting in an operational frequency $F_{op}$, which can be approximately two-thirds of $F_{fil}$ or less. The higher frequency $F_{fil}$ causes higher heat production in the filaments, which is favourable for a quick start in cold circumstances. Lower operational frequency results in lower power consumption by the filaments and lower heat production, which are both advantageous in battery powered and/or cooled environments. This effect may also extend the lifetime of the filaments.

It is further noted that although in FIG. 1 the capacitor 35 is located in between the operating winding 33 and the triac element 37, persons skilled in the art will recognise that the capacitor 35 may be located anywhere in the secondary part of the circuit.

The circuit according to the present invention, does not use an NTC or a PTC. Heat dissipation is minimised in this way. The invention provides a very compact ignition circuit, which can be used in a lighting fixture for a gas discharge lamp, like for example a fluorescent lamp. The circuit according to the invention can be powered by a low voltage DC source, which is favourable in many outdoor applications.

The diode 6 and the capacitor 7 are not relevant for the invention. They are used as a stabilising circuit. The fuse 3 is optional too. Furthermore, the resistors may comprise several resistors in parallel, as is know to the person skilled in the art.

It will be clear that other embodiments are possible. For example the triac 37 may be replaced by a rectifier and a transistor, or any other solid state switch.

What is claimed is:

1. An electronic circuit for controlling the ignition of a pre-heat type gas discharge lamp comprising:

an operating winding (33) for supplying a high voltage AC to opposite electrodes of the gas discharge lamp;

filament power supply means (39, 41) for heating filaments of the gas discharge lamp;

a delay switch (37) for switching on of the operating winding (33) only after a predetermined delay time after a switching on of the filament power supply means (39, 41), wherein said delay switch (37) comprises a solid-state switch said electronic circuit comprising a capacitor (9), a first resistor (11) and a second resistor (13) being serially connected between a positive (2) and a negative (4) terminal of said electronic circuit, said capacitor (9) and said first and second resistor (11, 13) forming a DC voltage divider for controlling a delayed switching of said solid-state switch (37).

2. An electronic circuit according to claim 1, wherein said circuit comprises:

a transformer comprising primary windings (23, 29, 31) and secondary windings (33, 39, 41), arranged to transform a low voltage AC current in a primary part of said circuit into a high voltage AC current in a secondary part of said circuit;

an oscillator (19, 21, 23, 25, 27, 29, 31) being connected to the primary windings of the transformer and, in use, having a startup resonance frequency ($F_{fil}$) while said delay switch (37) is switched off, and wherein said secondary windings comprise said operating winding (33).

3. An electronic circuit according to claim 2, wherein said filament power supply means (39, 41) comprise filament heating windings which are part of said secondary windings.

4. An electronic circuit according to claim 1, wherein said solid-state switch (37) comprises a triac.

5. An electronic circuit according to claim 1, wherein said solid-state switch (37) comprises a solid-state transistor.

6. An electronic circuit according to claim 1, wherein switching of said solid-state switch (37) is controlled by a voltage in a primary part of said electronic circuit.

7. An electronic circuit according to claim 1, wherein a secondary part of said circuit comprises a resonator, which has a resonance frequency lower than said startup resonance frequency ($F_{fil}$) of said oscillator (19, 21, 23, 25, 27, 29, 31) in said primary part of said circuit.

8. An electronic circuit according to claim 7, wherein said circuit, in use while said delay switch (37) is switched on, has an operating frequency (Fop), which is less than two-thirds of said startup resonance frequency ($F_{fil}$).

9. An electronic circuit according to claim 7, wherein said resonator comprises a capacitor (35) and said operating winding (33).

10. An electronic circuit according to claim 3, wherein switching of said solid-state switch (37) is controlled by a voltage in said primary part of said electronic circuit.

11. An electronic circuit according to claim 3, wherein said secondary part of said circuit comprises a resonator, which has a resonance frequency lower than said startup resonance frequency ($F_{fil}$) of said oscillator (19, 21, 23, 25, 27, 29, 31) in said primary part of said circuit.

12. An electronic circuit according to claim 11, wherein said circuit, in use while said delay switch (37) is switched on, has an operating frequency ($F_{op}$), which is less than two-thirds of said startup resonance frequency ($F_{fil}$).

13. An electronic circuit according to claim 11, wherein said resonator comprises a capacitor (35) and said operating winding (33).

14. A lighting fixture comprising an electronic circuit according to claim 1.

15. A lighting fixture comprising an electronic circuit according to claim 3.

16. An electronic circuit for controlling the ignition of a pre-heat type gas discharge lamp comprising:

an operating winding (33) for supplying a high voltage AC to opposite electrodes of the gas discharge lamp;

filament power supply means (39, 41) for heating filaments of the gas discharge lamp;

a delay switch (37) for switching on of the operating winding (33) only after a predetermined delay time after a switching on of the filament power supply means (39, 41), wherein said delay switch (37) comprises a solid-state switch and said electronic circuit comprises:

a transformer comprising primary windings (23, 29, 31) and secondary windings (33, 39, 41), arranged to transform a low voltage AC current in a primary part of said circuit into a high voltage AC current in a secondary part of said circuit;

an oscillator (19, 21, 23, 25, 27, 29, 31) being connected to the primary windings of the transformer and, in use, having a startup resonance frequency ($F_{fil}$) while said delay switch (37) is switched off, and wherein said secondary windings comprise said operating winding (33).

17. An electronic circuit according to claim 16, wherein said filament power supply means (39, 41) comprise filament heating windings which are part of said secondary windings.

18. An electronic circuit according to claim 17, wherein switching of said solid-state switch (37) is controlled by a voltage in said primary part of said electronic circuit.

19. An electronic circuit according to claim 17, wherein said electronic circuit comprises a capacitor (9), a first resistor (11) and a second resistor (13) being serially connected between a positive (2) and a negative (4) terminal of said electronic circuit, said capacitor (9) and said first and second resistor (11, 13) forming a DC voltage divider for controlling a delayed switching of said solid-state switch (37).

20. An electronic circuit according to claim 17, wherein said secondary part of said circuit comprises a resonator, which has a resonance frequency lower than said startup resonance frequency ($F_{fil}$) of said oscillator (19, 21, 23, 25, 27, 29, 31) in said primary part of said circuit.

21. An electronic circuit according to claim 20, wherein said circuit, in use while said delay switch (37) is switched on, has an operating frequency ($F_{op}$), which is less than two-thirds of said startup resonance frequency ($F_{fil}$).

22. An electronic circuit according to claim 20, wherein said resonator comprises a capacitor (35) and said operating winding (33).

* * * * *